US009822805B2

(12) United States Patent
De Gier

(10) Patent No.: US 9,822,805 B2
(45) Date of Patent: Nov. 21, 2017

(54) HYDRAULIC CYLINDER FOR USE FOR EXAMPLE IN A HYDRAULIC TOOL

(71) Applicant: DEMOLITION AND RECYCLING EQUIPMENT B.V., St. Anthonis (NL)

(72) Inventor: Gertrudis Maria Gerardus De Gier, St. Anthonis (NL)

(73) Assignee: Demolition and Recycling Equipment B.V., St. Anthonis (NL)

( * ) Notice: Subject to any disclaimer, the term of this patent is extended or adjusted under 35 U.S.C. 154(b) by 663 days.

(21) Appl. No.: 14/301,267

(22) Filed: Jun. 10, 2014

(65) Prior Publication Data

US 2014/0360349 A1 Dec. 11, 2014

Related U.S. Application Data

(60) Provisional application No. 61/833,666, filed on Jun. 11, 2013.

(30) Foreign Application Priority Data

Jun. 11, 2013 (NL) ..... 2010952

(51) Int. Cl.
*F15B 15/14* (2006.01)
*F15B 13/04* (2006.01)
(Continued)

(52) U.S. Cl.
CPC ..... *F15B 15/149* (2013.01); *E02F 3/965* (2013.01); *E02F 9/2267* (2013.01);
(Continued)

(58) Field of Classification Search
CPC .... F15B 11/0445; F15B 11/0413; F15B 9/08; F15B 20/007
(Continued)

(56) References Cited

U.S. PATENT DOCUMENTS 4,353,286 A * 10/1982 Wetter ..... B22D 11/16 137/486
4,614,148 A 9/1986 Bates
(Continued)

FOREIGN PATENT DOCUMENTS

EP 0641618 A1 3/1995
EP 0867567 A2 9/1998
JP 2004-49990 A 2/2004

*Primary Examiner* — Edelmira Bosques
*Assistant Examiner* — Richard Drake
(74) *Attorney, Agent, or Firm* — Roberts & Roberts, LLP

(57) ABSTRACT

The invention relates to a hydraulic cylinder, for example for use in a hydraulic tool, comprising at least one piston/cylinder combination composed of a cylinder body and a piston accommodated in said cylinder body and provided with a piston rod that projects from said cylinder body, wherein the cylinder body and the piston body define a first cylinder chamber while the cylinder body, the piston body and the piston rod define a second cylinder chamber, and wherein during operation the piston performs alternating forward and return operational cycles under the influence of a fluidum under pressure that is conducted to the first and the second cylinder chamber through a first and a second line, respectively, and a control valve which regulates the supply of a fluid under pressure through the first or the second line to the piston/cylinder combination.

8 Claims, 5 Drawing Sheets

(51) Int. Cl.

| | |
|---|---|
| ***E02F 3/96*** | (2006.01) |
| ***F15B 11/024*** | (2006.01) |
| ***F15B 20/00*** | (2006.01) |
| ***E02F 9/22*** | (2006.01) |
| *F15B 11/02* | (2006.01) |

(52) U.S. Cl.
CPC ..... *E02F 9/2271* (2013.01); *F15B 11/024* (2013.01); *F15B 13/0401* (2013.01); *F15B 20/007* (2013.01); *F15B 11/022* (2013.01); *F15B 2011/0243* (2013.01); *F15B 2211/3058* (2013.01); *F15B 2211/30505* (2013.01); *F15B 2211/329* (2013.01); *F15B 2211/355* (2013.01); *F15B 2211/50518* (2013.01); *F15B 2211/5153* (2013.01); *F15B 2211/55* (2013.01); *F15B 2211/775* (2013.01); *F15B 2211/8636* (2013.01); *F15B 2211/8752* (2013.01)

(58) Field of Classification Search
USPC ..... 91/171, 420; 241/30; 60/374
See application file for complete search history.

(56) References Cited

U.S. PATENT DOCUMENTS

| | | | | |
|---|---|---|---|---|
| 5,259,293 | A * | 11/1993 | Brunner | F15B 11/003 91/420 |
| 5,826,486 | A * | 10/1998 | Shimada | E02F 9/2203 60/460 |
| 5,996,465 | A | 12/1999 | Morikawa et al. | |
| 7,448,309 | B2 * | 11/2008 | Bitter | B66F 9/065 91/418 |
| 8,413,688 | B2 * | 4/2013 | Bassoli | F15B 11/0445 91/420 |
| 8,800,426 | B2 * | 8/2014 | Andersson | E02F 9/2203 91/420 |
| 2006/0000349 | A1 | 1/2006 | Cossette et al. | |
| 2016/0186787 | A1 * | 6/2016 | Opdenbosch | F15B 11/0445 60/459 |

* cited by examiner

--PRIOR ART--

--PRIOR ART--

--PRIOR ART--

HYDRAULIC CYLINDER FOR USE FOR EXAMPLE IN A HYDRAULIC TOOL

DESCRIPTION

The invention relates to a hydraulic cylinder, for example for use in a hydraulic tool, comprising at least one piston/cylinder combination composed of a cylinder body and a piston accommodated in said cylinder body and provided with a piston rod that projects from said cylinder body, wherein the cylinder body and the piston body define a first cylinder chamber while the cylinder body, the piston body and the piston rod define a second cylinder chamber, and wherein during operation the piston performs alternating forward and return operational cycles under the influence of a fluidum under pressure that is conducted to the first and the second cylinder chamber through a first and a second line, respectively, and a control valve which regulates the supply of a fluid under pressure through the first or the second line to the piston/cylinder combination.

A hydraulic tool operated by means of a hydraulic cylinder as described above is known, for example, from European Patent no. 0641618. This patent document discloses a frame that can be coupled to a jib of an excavator or similar machine and to which an assembly of two jaws can be coupled. One of the jaws can be pivoted relative to the other jaw by means of a hydraulic actuating cylinder (a double-acting piston/cylinder combination).

During the forward or outward stroke of the piston rod of the actuating cylinder, the pivotable jaw is moved towards the other, fixed jaw, whereas the return or inward stroke of the piston rod moves the pivotable jaw away from the fixed jaw. To achieve this, a hydraulic actuating cylinder of this kind is of a double-acting construction.

Large and expensive hydraulic actuating cylinders with separation valves (also often denoted differential valves) are generally used in demolition equipment such as concrete crushers and metal shears, etc. The separation valve ensures that the piston (and the piston rod) are quickly operated in the no-load situation through regeneration of the fluid used (oil) at the piston rod side of the piston. Shorter cycle times are achieved thereby. It is not until the piston rod is loaded that the separation valve switches such that the fluid at the piston rod side can flow freely back to the hydraulic system of the demolition equipment (for example a hydraulic tank). The piston can then supply its maximum force.

In practice there are several variations in the design of the separation valve, but the operating principle remains the same. The hydraulic actuating cylinders usually operate with high working pressures (350-380 bar) and high fluid flow rates (>>300 l of oil per minute), usually accompanied by high peak pressures. An actuating cylinder of such a tool is controlled or energized by the hydraulic system of the relevant machine, the construction thereof thus determining to a certain extent the available working pressure of the fluid and the fluid flow rate that can be supplied.

A risk in the existing hydraulic actuating cylinders is that the repeatedly occurring high peak pressures and fluid flows through the lines in operation can lead to malfunctions or obstructions in the hydraulic system. For example, if the hydraulic line providing the discharge of fluid from the second cylinder chamber should be blocked while the hydraulic line to the first cylinder chamber is clear, this will have fatal consequences for the separation valve, and especially for the hydraulic actuating cylinder.

The sudden high back pressure caused by a malfunction in the relevant hydraulic line will immediately block the separation valve. A very high peak pressure will thus be applied to the piston rod side of the actuating cylinder, which peak pressure may be considerably increased in the actuating cylinder in dependence on the bore/rod ratio of the actuating cylinder. Such peak pressures can lead to permanent damage to the moving parts of the actuating cylinder as well as to the various lines and/or seals, such that parts may become permanently deformed (inflated) and expensive repairs will be necessary.

Such damage can be avoided in that, for example, a release valve is included in the system, which valve either discharges fluid to the hydraulic system of the excavator machine via an additional discharge line or discharges the fluid externally to the environment. Both solutions, however, have their disadvantages. An additional release valve line renders the hydraulic system more expensive, more complicated and more prone to failure, while the second solution causes undesirable environmental pollution.

The invention accordingly has for its object to provide an improved actuating cylinder as described in the opening paragraph which immediately acts on the hydraulic system in the event of the emergency situations sketched above and which prevents permanent damage to the various components.

According to the invention, the hydraulic cylinder is for this purpose characterized in that it comprises a safety valve which is passive in a first position and which in a second position, if the pressure in the second cylinder chamber is higher than a preset load pressure, connects the second cylinder chamber to the first cylinder chamber via the separation valve.

It is prevented in this manner that the separation valve remains blocked; instead, it is opened by the safety valve so that the pressure in the actuating cylinder can equalize and cannot rise further to above the maximum working pressure. The actuating cylinder is designed to withstand at least this maximum working pressure, so that no damage will occur.

Since the safety valve is incorporated in the hydraulic system and the fluid remains inside the system, additional leakage lines are not necessary. This renders the design of the hydraulic cylinder less complicated. If leakage lines are used, by contrast, the working pressure (i.e. the fluid) will be freely exhausted into the external environment in the case of a calamity, which is undesirable in view of the resulting pollution.

In a first embodiment, the separation valve is constructed as a non-return valve arranged between the first and the second line, while in another embodiment the separation valve is constructed as a differential valve. The differential valve may then comprise a non-return valve located between the first and the second line.

The differential valve may further comprise a valve included in the second line, which valve connects the second cylinder chamber to the second line if the pressure in the first cylinder chamber is higher than a preset value. As a result, the piston is now capable of providing its maximum force.

According to a further characteristic of the invention, the safety valve comprises a valve which in a first position maintains the pressure in a control line of the separation valve and which in a second position releases the pressure in the control line of the separation valve. The pressure in the actuating cylinder can thus equalize and will not rise further than up to the maximum working pressure. The actuating cylinder is designed for at least this maximum working pressure, so that damage will not occur.

The safety valve further comprises a first non-return valve which connects the second line to a control line of the valve, while in addition the control surface of the valve is of a stepped design. It is prevented thereby that the actuating cylinder remains in operation when a malfunction as described above occurs. The non-return valve of the safety valve will thus remain inactivated because the pressurized fluid in the control line is enclosed by the relevant non-return valve and the stepped control surface of the valve. The valve accordingly does switch at a high peak pressure (caused by the malfunction in the hydraulic line), but it is subsequently kept in this switched state also at a lower equalized pressure.

According to the invention, furthermore, the safety valve comprises a further non-return valve which connects the second line to the control line of the separation valve. The control line of the separation valve can be depressurized thereby during normal operation.

The invention will now be explained in more detail with reference to a drawing, in which:

FIGS. 1*a* and 1*b* are elevations of an embodiment of a hydraulic tool according to the present state of the art, coupled to a jib of an excavator;

Corresponding components will be indicated with the same reference numerals in the ensuing description of the figures for a better understanding of the invention.

Figure 1B:
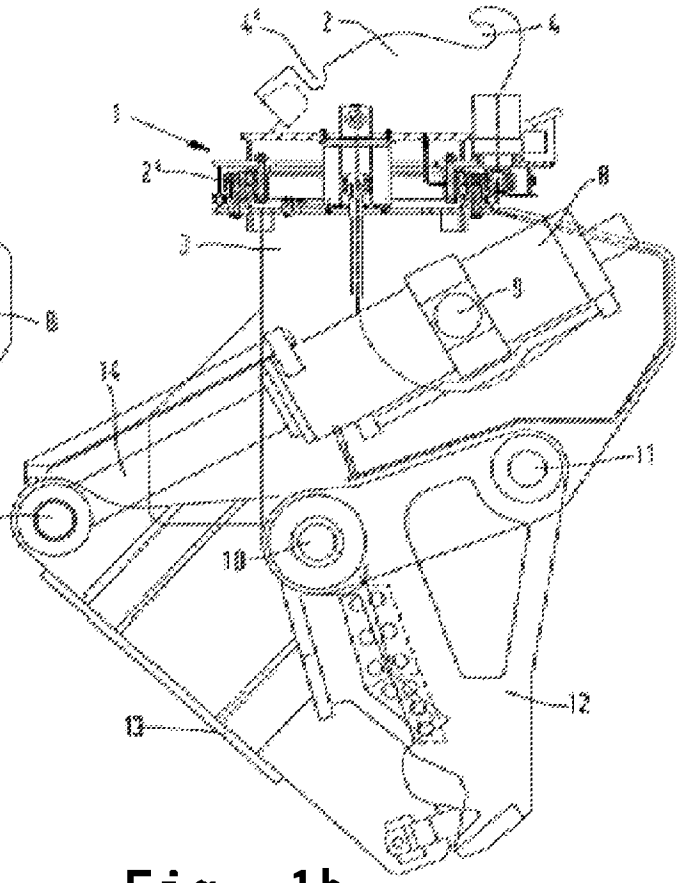
Figure 1A:
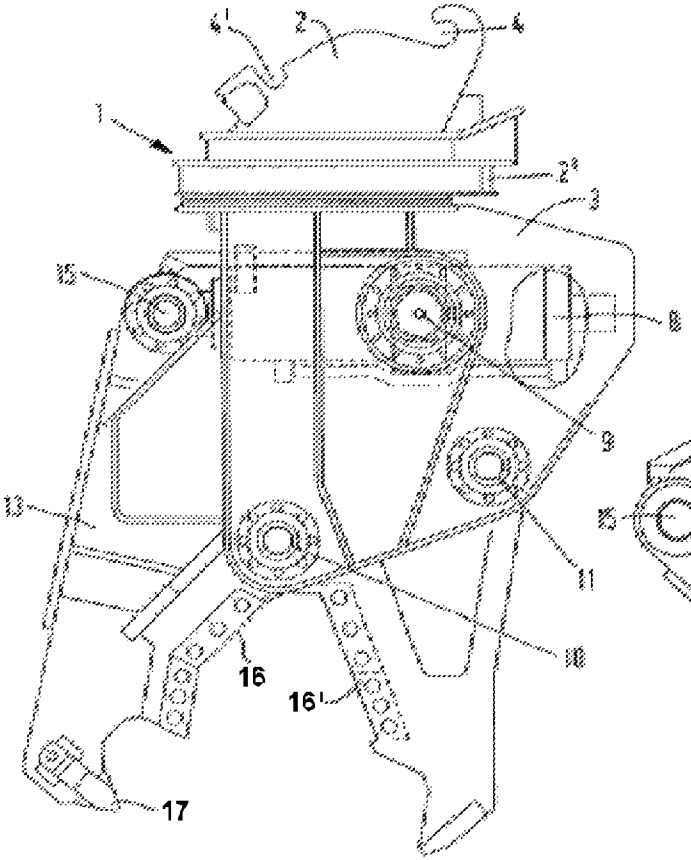

The FIGS. 1*a* and 1*b* show two elevations of a hydraulic tool that is driven or energized by a hydraulic actuating cylinder. The tool shown is according to the present state of the art and comprises a frame 1 that comprises a first frame part 2 which is coupled to a second frame part 3 by means of a turntable 2'. The two frame parts 2 and 3 can be rotated relative to one another by the turntable 2' and by means (not shown) that are known per se, for example hydraulically operated adjustment means.

The frame part 2 is equipped with coupling means 4, 4' which are known per se and by means of which the device 1 can be coupled to, for example, the end of an arm of an excavator or similar piece of heavy equipment.

A first jaw 12 is fastened to the frame part 3 of the frame 1 by means of a hinge pin 10 and a pin 11. The two pins 10 and 11 are accommodated in fitting openings or bores (not shown) provided in the frame part 3. A second movable jaw 13 is pivotably arranged about the hinge pin 10.

The second movable jaw 13 can be pivoted relative to the first jaw 12 by the actuating cylinder 8, for which purpose the end 14*a* of a piston rod 14 is coupled to an end of the pivotable jaw 13 by means of a pin 15. The hydraulic actuating cylinder 8 is accommodated in the frame part 3 with pivoting possibility about a point 9 so as to make possible the stroke of the piston rod 14.

FIG. 1*a* shows the hydraulic tool in an operational state where the piston rod 14 is fully retracted (return stroke) and FIG. 1 *b* shows the forward stroke of the piston rod 14, i.e. with the jaw 13 being moved against the jaw 12. It is possible with such a hydraulic tool to carry out demolition, breaking of shearing jobs, for which huge cylinder forces can be applied to the jaws 12 and 13.

Figure 2:
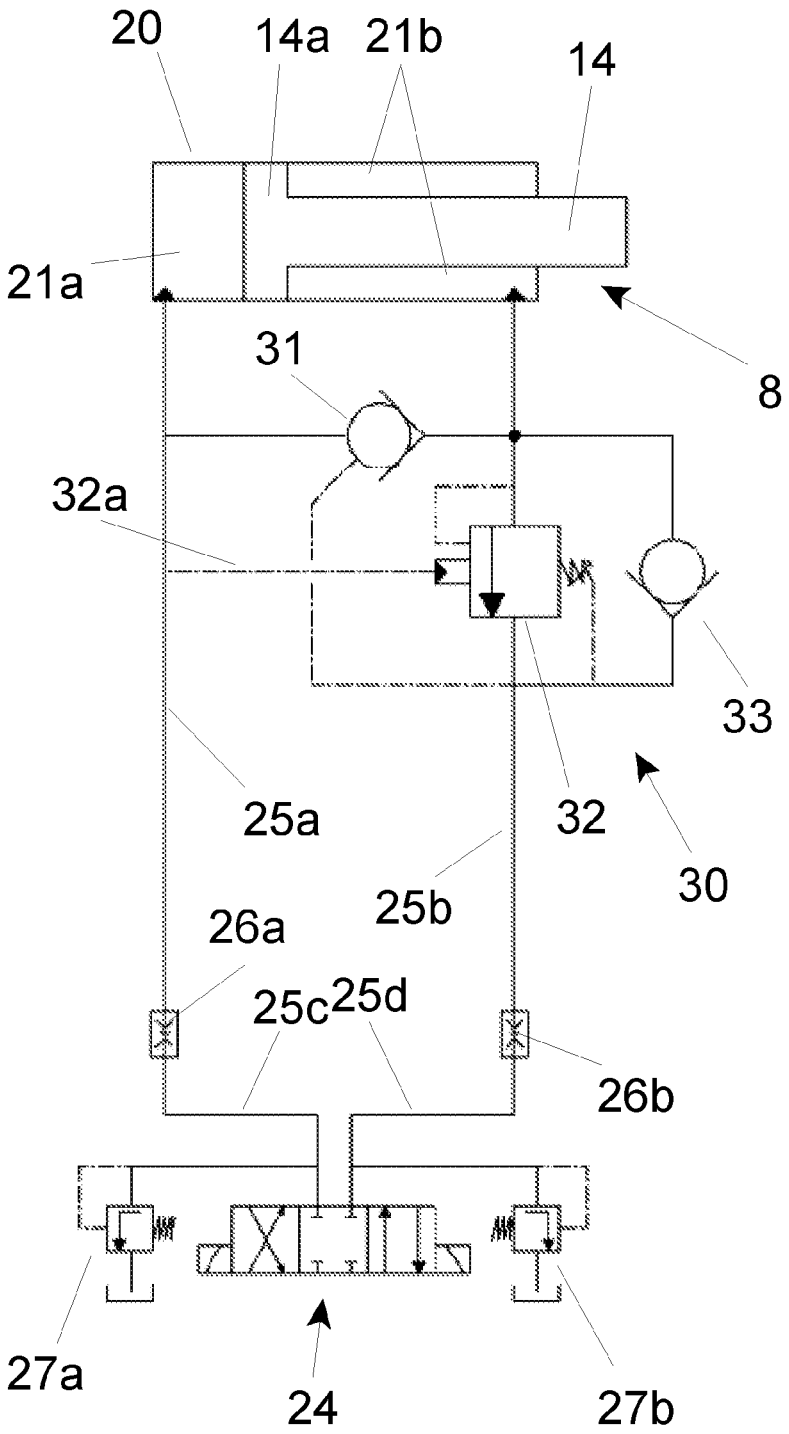
FIG. 2 shows a basic design of a hydraulic cylinder according to the present state of the art.

FIG. 2 shows an embodiment of the hydraulic system with a hydraulic actuating cylinder according to the present state of the art in more detail. Reference numeral 8 denotes a double-acting hydraulic piston/cylinder combination, for example a hydraulic compression cylinder that can be used in a hydraulic tool as shown in FIGS. 1*a* and 1*b*. The double-acting hydraulic piston/cylinder combination 8 is built up from a cylinder 20 in which a piston 14*a* is accommodated such that it can move to and fro. Said piston 14*a* is provided with a piston rod 14 which projects from the cylinder housing 20. The piston 14-14*a* divides the cylinder housing into two chambers. The first cylinder chamber 21*a* is defined by the piston 14*a* and the cylinder chamber 20, while the second cylinder chamber 21*b* is defined by the piston 14*a*, the piston rod 14, and the cylinder chamber 20.

A fluid, preferably oil, is conducted under pressure into the two cylinder chambers 21*a*, 21*b* by means of a control valve 24 and first and second fluid supply lines 25*a*, 25*b*, respectively, during operation.

The control valve 24 herein forms part of the compression hydraulics of, for example, a jib of an excavator, whereas the piston/cylinder combination 8 forms part of a hydraulic auxiliary tool that is to be fastened to the jib of the excavator by means of a mechanical coupling. The hydraulic coupling is formed by the respective line couplings 26*a* and 26*b* with which the hydraulic lines 25*a*, 25*b* are coupled to the respective corresponding hydraulic lines 25*c*, 25*d*. The hydraulic lines 25*c*, 25*d* together with the control valve 24 form part of the hydraulic system of the relevant excavator.

FIG. 2 shows the control valve 24 in its neutral central position. For moving the piston rod 14 from the cylinder, the control valve 24 should be brought into a left-hand position when viewed in FIG. 2, so that the fluid can be conducted under pressure through the lines 25*c* and 25*a* to the first cylinder chamber 21*a*. During the forward stroke of the piston rod 14 the fluid present in the second cylinder chamber 21*b* will be pressed out therefrom and be returned through the separation valve 30, in particular the non-return valve 31, to the first cylinder chamber 21*a*.

The separation valve (also denoted differential valve) 30 regulates the discharge of fluid under pressure from the second cylinder chamber 21*b* in dependence on the pressure obtaining between the first and the second cylinder chamber 21*a*, 21*b*. The separation valve 30 becomes operational in particular the moment the projecting piston rod 14 is loaded, whereby the pressure in the supply line 25*a*, and in particular in the first cylinder chamber 21, is further increased. The increased fluid pressure will switch the shut-off valve 32 via the control line 32*a* such that fluid can flow back under pressure directly from the second cylinder chamber 21*b* through the return line 25*b*, the opened valve 32, the hydraulic line 25*d*, and the control valve 24 to the hydraulic system of the excavator, in particular to a hydraulic tank (not shown).

It is noted that the reference numerals 27*a* and 27*b* shown in the first hydraulic lines 25*c*, 25*a* and the second hydraulic lines 25*d*, 25*c*, respectively, denote so-termed protection valves of the excavator. These protection valves are designed for a slightly higher pressure than the maximum working pressure of the excavator.

When the valve 32 is open, fluid will flow under pressure from the second cylinder chamber 21*b* freely back into the hydraulic system of the excavator. The high pressure in the supply line 25*a*, or the second cylinder chamber 21*a*, will cause the non-return valve 31 to remain closed, so that no fluid can flow under pressure between the first cylinder chamber 21*a* and the second cylinder chamber 21*b*. Any short-circuiting of the system is prevented thereby.

Figure 3:
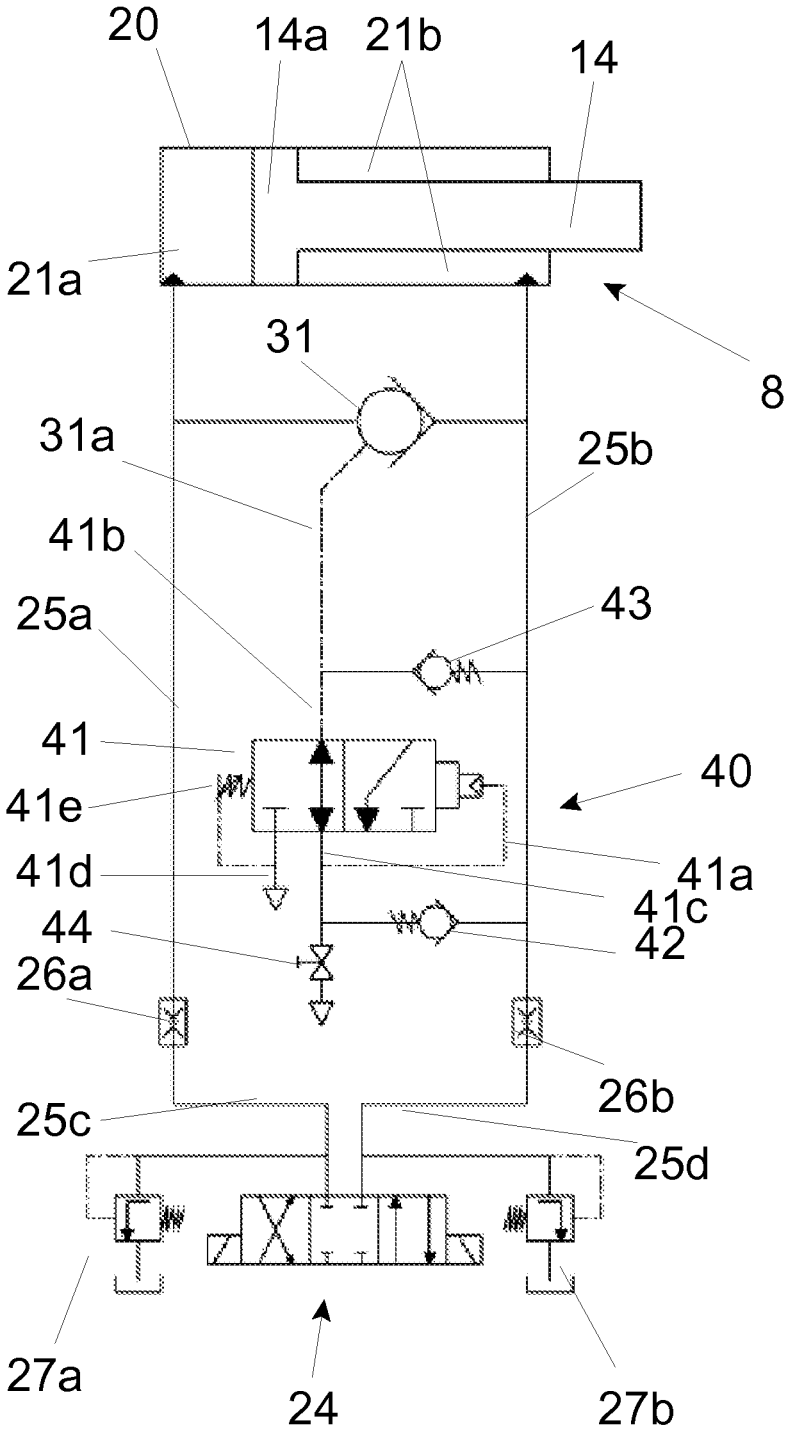
FIGS. 3 and 4 represent configurations of a hydraulic cylinder according to the invention.

FIG. 3 discloses an adaptation of the existing hydraulic system as shown in FIG. 2, now provided with a safety feature (referenced 40) for the case of an obstruction occurring in the hydraulic system, in particular in case of a blocking of the second supply line 25*b*.

An obstruction may occur in the second supply line 25*b* in the existing systems, for example owing to an incorrectly applied or burst coupling 26*b* or owing to a defective coupling caused by high peak pressures in the line. In such an undesirable situation the pressure in the line 25*b* will rise very quickly, which causes the separation valve (or differential valve) 30 to become blocked owing to the very high back-pressure in the line 25*a* and the cylinder chamber 21*a*.

This causes a very high pressure in the system, also owing to the outward travel of the piston rod 14, which pressure may lead to very high pressures applied to the contact surfaces of the piston in the second cylinder chamber 21*b*, also in dependence on the ratio of the diameter of the cylinder chamber 20 to the diameter of the piston rod 14. A working pressure of 350-380 bar can thus be increased by a factor of two up to 700-800 bar in usual hydraulic systems.

These exceptionally high working pressures in the second cylinder chamber 21*b* may cause permanent damage to the moving parts of the piston/cylinder combination. In particular, permanent deformations of the cylinder chamber 20 or damage to lines and seals may arise, which cause long-term standstill periods and expensive repairs. In the worst case the double-acting hydraulic cylinder 8 may even 'explode'.

The safety valves 27*a* and 27*b* of the excavator do not provide a solution in such a case because the blockage in the line 25*b* is located between the safety valves 27*a*, 27*b* and the hydraulic actuating cylinder 8 that is 'under threat'.

The solution to this problem shown in FIG. 3 involves a safety valve that is referenced 40. It is noted that FIG. 3 shows a simplified version of the hydraulic system in which the separation valve is constructed as a single one-way valve 31.

The safety valve 40 comprises a valve 41 which assumes a first position as shown in FIG. 3 during normal operation of the hydraulic compression cylinder 8. The valve is passive in this position and it will only be switched to a second position when the pressure in the second cylinder chamber 21*b* is higher than a preset load pressure. Such a pressure will only occur if the line 25*b* is blocked and the working pressure in the line 25*b* and the second cylinder chamber 21*b* rises to an unacceptable level, owing to the fact that fluid under pressure cannot be discharged or exhausted because the separation valve 31 is blocked.

Said preset load pressure is defined by the spring pressure of the valve spring 41*e*. When the valve 41 is switched to its second position, according to the invention, the control line of the separation valve 31 is relieved, whereby the blockage of the valve 31 is lifted and accordingly the second cylinder chamber 21*b* comes into communication with the first cylinder chamber 21*a* via the separation valve 31.

The functionality of the safety valve and in particular of the valve 40 lies in the fact that it switches on actively if owing to a malfunction in the second supply line 25*b* the pressure in this second supply line 25*b* and accordingly in the second cylinder chamber 21*b* reaches an unacceptably high value. As was explained above, such high pressure values in the second supply line 25*b* and in the second cylinder chamber 21*b* may lead to very high peak pressures which cause damage to or deformation of the cylinder, safety valves and connection lines.

Since the separation valve 31 is in the blocked state in such a case, the fluid under pressure cannot find a way out through the one-way valve 31 to the first supply line 25*a* and the first cylinder chamber 21*a*. As is shown in FIG. 3, the control line 31*a* of the one-way valve 31 is connected to the input 41*b* of the valve 41 of the safety valve 40. In the first, passive position of the valve 41, the input 41*b* is directly connected to a first output 41*c* of the valve 41. In the first switched position of the valve 41 shown in FIG. 3, the first output 41*c* of the valve 41 is blocked by a closed discharge valve 44 at one side and by a first one-way valve 42 that is in connection with the second supply line 25*b* at the other side.

In this first position of the valve 41, the pressurized control line 31*a* is closed off from the one-way valve 31, so that the one-way valve 31 cannot open and cannot discharge fluid from the second cylinder chamber 21*b* towards the first cylinder chamber 21*a*. The control line 31*a* is also connected to the line 25*b* via a second non-return valve 43, but this second non-return valve 43 is also closed owing to the high pressure in the line at 25*b*. The separation or differential valve is blocked in this situation. The second non-return valve 43 has the task of relieving the pressure in the control line 31*a* of the separation valve 31 during normal operation.

Figure 4:
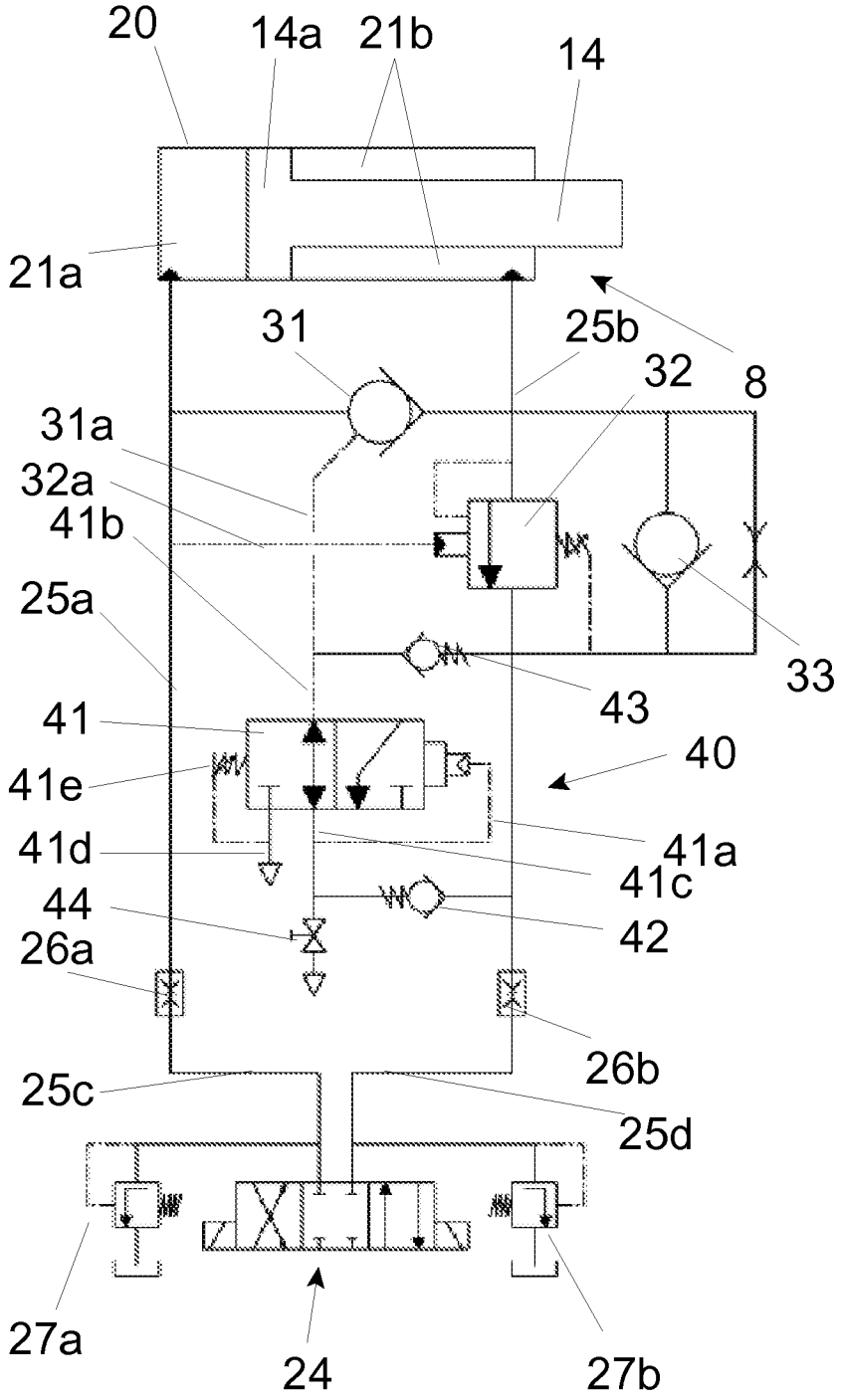

The safety valve 40 according to the invention was developed and included in the hydraulic system as shown in FIGS. 3 and 4 in order to deal with such an undesirable operational situation.

A further rise in the working pressure in the supply line 25*b* and the second cylinder chamber 21*b* to above a preset load pressure achieves that the first constriction or first one-way valve 42 is opened. The pressure obtaining in the second supply line 25*b* and the second cylinder chamber 21*b* is applied to the control line 41*a* of the valve 41 via the opened first constriction 42 as a result of this. This switches the valve 41 from its first, passive state to its second, active state wherein the input 41*b* of the valve 41 is connected through to the open second output 41*d*.

The pressurized control line 31*a* of the blocked valve 31 can now relieve its pressure through the second output 41*d*. A minimal quantity of fluid (oil) is discharged during this. Since the pressure in the control line 31*a* has dropped, the one-way valve 31 of the separation valve 30 can open under the influence of the pressure obtaining in the second supply line 25*b* and the second cylinder chamber 21*b*. Fluid under pressure can be guided from the second cylinder chamber 21*b* through the separation valve 31 to the first cylinder chamber 21*a*. The pressures in the cylinder chambers are equalized in this manner.

The actuating cylinder 8 is in the differential position owing to the one-way valve 31 being open, and the piston rod 14 will move into its extreme displacement position. The maximum pressure that can arise in the hydraulic system is thus equal to the maximum working pressure. Since the hydraulic system and the hydraulic actuating cylinder 8 were designed for this maximum working pressure, the hydraulic system (moving parts, lines and safety valves) is no longer subjected to excessive peak pressures in the lines. Undesired damage and deformations in the system and the actuating cylinder (and thus standstill and expensive repairs) are prevented thereby.

The configuration of the valve 41 implies that it will remain in the second state. The fluid under pressure applied to the control line 41*a* and the control surface 41*e* of the valve 41 via the second supply line 25*b* and the first one-way valve 42 will remain enclosed by the first output 41*c* (now closed) and the one-way valve 42 in the blocking state and the discharge valve 44.

According to the invention, the control surface 41*e* of the valve 41 is of a stepped design, which means that the valve 41 remains switched to its second state and will not switch back to its first, passive state upon a drop in pressure in the line. This ensures that the actuating cylinder 8 can be moved outward to its differential position via the differential valve 31 at the switching moment of the valve 41 of the safety valve 40 from its first to its second position, but that it cannot be operated in the normal manner anymore after this.

It is accordingly necessary first to deal with the malfunction that caused the safety valve 40 to be activated and to relieve the enclosed pressure (with the valve 41 in its second state) applied to the control line 41*a* (and 41*c*) in that the discharge valve 44 is opened by hand. The safety valve 40 is reset by this.

The embodiment of FIG. 3 comprises a simple separation valve in the form of a one-way valve 31, whereas FIG. 4 shows an embodiment of a hydraulic system provided with a differential valve as shown in FIG. 2 and a safety valve according to the invention. In this embodiment, the differential valve 31 has not only a safety function as described above, but also a function in the differential circuit 30, i.e. the regeneration of fluid from the cylinder chamber 21*b* to the cylinder chamber 21*a*.

For use of the safety valve 40 as described in FIGS. 3 and 4, this valve may be included as a separate valve in the hydraulic system.

Alternatively, however, the valve 40 may be combined with the differential valve 30 (31) and thus be included as a unit in the hydraulic system.

Figure 5:
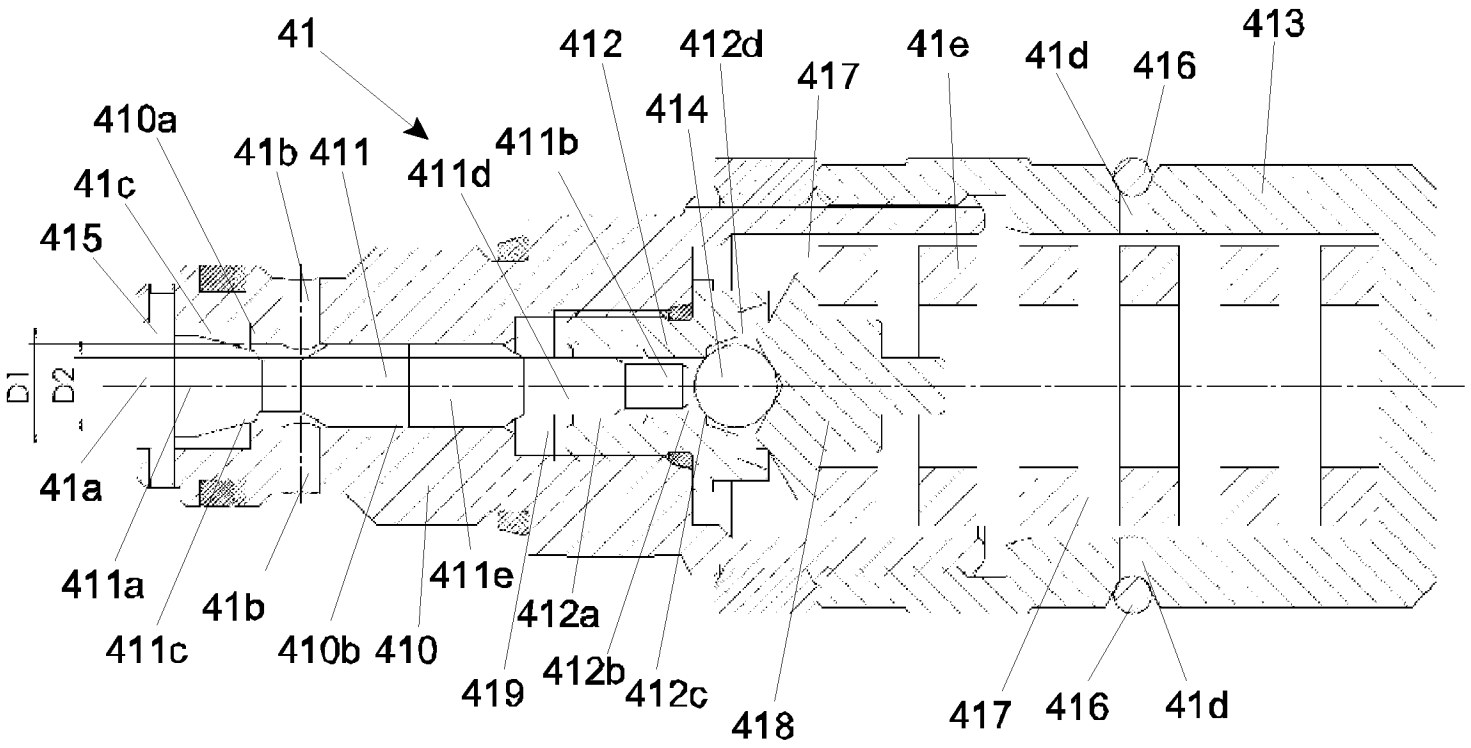
FIG. 5 shows an embodiment of a safety valve according to the invention.

An example of a safety valve 41 is shown in FIG. 5. The valve 41 is built up from a valve housing 410 in which a valve body 411 is movably arranged. The valve housing 410 has a widened chamber 419 in which a valve seat 412 has been screwed home. The valve seat 412 has a first bore 412*a* which merges into a second bore 412*b* inside which an end 411*b* of the valve body can move. The diameter of the first bore 412*a* is greater than the diameter D2 of the second bore 412*b*. This bore 412*b* has a diameter D2 which is greater than the diameter of the valve body end 411*b*. The valve body portion 411*d* has a diameter equal to the diameter D2 of the bore 412*b*, but smaller than the diameter of the first bore 412*a*.

The valve seat 412 and in particular the bore 412*b* can be closed off adjacent the abutment edge or valve seat edge 412*c* by a ball 414 which is pressed against the valve seat 412 by means of a ball seat 418 and a valve spring 41*e*. The ball seat 418 and the valve spring 41*e* are accommodated in a spring housing 413 which has been screwed onto the valve housing 410. The spring housing 413 is provided with through bores 41*d* which are sealed off by means of an O-ring 416. The space 417 in the spring housing 413 is filled with air and is in communication with the atmosphere via the bores 41*d*.

The valve body 411 (in fact the valve body portion 411*e*) has a diameter D1 which is somewhat smaller than the bore 410*b* of the valve housing 410 in which the valve body 411 is accommodated. There is accordingly a small clearance between the valve body portion 411*e* and the bore 410*b*. The valve body 411 bears with its end 411*b* on the ball 414 at one side while its other end 411*a* is secured in the valve housing 410 by a locking pin 415. The valve body 411 can thus move inside the valve housing 410, but it cannot drop out.

The valve housing 410 has an input 41*b* (see also FIGS. 3 and 4) which is connected to the control line 31*a* of the separation or differential valve 31. In its first, passive state, the input 41*b* is directly connected to the input 41*c* (via the bevelled face 411*c* of the valve body end 411*a*). The input 41*c*, as is shown in FIGS. 3 and 4, is connected to the second supply line 25*b* via the first one-way valve 42.

The position shown in FIG. 5 relates to the 'passive' state of the safety valve as explained above with reference to FIGS. 3 and 4. The valve spring 41*e* presses the ball 414 into the valve seat 412, closing it off in a leak-proof manner around the valve seat edge 412*c*. The widened chamber 419 of the valve housing 410 and the first bore 412*a* and the second bore 412*b* (having a diameter equal to D2) of the valve seat 412 are thus closed off from the space 417 of the spring housing 413, but they are in pressure communication with the inputs 41*a* and 41*c* via through the clearance between the bore 410*a* and the valve body portion 411*e* in the passive state. In other words, the pressure applied to the input 41*b* via the control line 31*a* is also applied to the input 41*c* and to the ball 414, which is urged against the valve seat 412 by the valve spring 41*e*.

This 'passive' position of the safety valve 41 is maintained as long as the pressure at the inputs 41*b*, 41*c* is lower than a preset load pressure. This preset load pressure will arise only when the line 25*b* is blocked and the working pressure in the line 25*b* and the second cylinder chamber 21*b* becomes unacceptably high. When this preset load pressure is exceeded, the valve body 411 will move inside the valve housing 410 such that the valve body end 411*b* presses the ball 414 away from the valve seat 412 (against the spring pressure of the spring 41*e*).

This leads to an immediate pressure reduction from the widened chamber 419, the first bore 412*a*, and the second bore 412*b* through the space 412*d* (past the ball 414) towards the space 417 in the spring housing 413, whereby the valve body 411 is pressed with its bevelled face 411*c* against the valve housing edge 410*a*, thus closing off the connection between the inputs 41*c* and 41*b*. Since the diameter D1 is greater than the diameter D2 of the bore 412*b*, the valve body 410 can now be kept in this closed position at a lower working pressure.

The inputs 41*c* and 41*b* are no longer interconnected either in this closed position. The input 41*b*, however, is in communication with the space 417 in the spring housing 413 via the clearance between the valve body 411 and the bore 410*b* (and the chamber 419 and the bores 412*a*, 412*b*). The control line 31*a* of the blocked separation valve 31 can thus relieve its pressure towards the atmosphere via the input 41*b* and the connection formed by the clearance between the valve body 411 and the bore 410*b*, the widened chamber 419, the bore 412*a*, the space 412*d* alongside the ball 414, and the space 417. The quantity of fluid thus discharged from the control line 31*a* is caught in the space 417 of the spring housing 413, so that pollution of the environment is prevented.

The two different diameters D1 and D2 of the valve body 411 give the valve body a stepped control surface on which the fluid can bear under pressure. Since D2 is smaller than D1, a greater force is required for pressing the ball 414 from the valve seat 412 against the spring pressure of the spring 41*e* in order to move the valve 41 from its first, passive position into its second, active position. In an embodiment, the spring pressure of the spring 41*e* is set such that the ball 414 is lifted from its valve seat 412 at a working pressure of at least 400 bar applied to the surface formed by the bore 412*b* having the diameter D2.

If the surface having the diameter D1 is, for example, twice the size of the surface having the diameter D2, the valve 41 will remain in its second position as long as the pressure in the line 41*c* (i.e. applied to the valve body end 411*a*) does not drop below 400/2=200 bar. This is achieved in that the discharge valve 44 is opened by hand, whereby the pressure in the line 41*c* is relieved.

The invention claimed is:

1. A hydraulic cylinder, for example for use in a hydraulic tool, comprising at least one piston/cylinder combination composed of a cylinder body and a piston accommodated in said cylinder body and provided with a piston rod that projects from said cylinder body, wherein the cylinder body and the piston body define a first cylinder chamber while the cylinder body, the piston body and the piston rod define a second cylinder chamber, and wherein during operation the piston performs alternating forward and return operational cycles under the influence of a fluid under pressure that is conducted to the first and the second cylinder chamber through a first and a second line, respectively, a control valve which regulates the supply of a fluid under pressure through the first or the second line to the piston/cylinder combination, and a separation valve which regulates the discharge of fluid under pressure from the second cylinder chamber in dependence on the pressure difference between the first and the second cylinder chamber, and a safety valve which is passive in a first position and which in a second position, if the pressure in the second cylinder chamber is higher than a preset load pressure, the second cylinder chamber comes into communication with the first cylinder chamber via the separation valve;

wherein the separation valve is constructed as a differential valve, which differential valve comprises a non-return valve arranged between the first and the second line, and wherein the differential valve further comprises a valve included in the second line, which valve connects the second cylinder chamber to the second line if the pressure in the first cylinder chamber is higher than a preset value.

2. The hydraulic cylinder according to claim 1 wherein the safety valve comprises a valve which in its first position maintains the pressure in a control line of the separation valve and which in its second position releases the pressure in the control line of the separation valve.

3. The hydraulic cylinder according to claim 2, wherein the safety valve comprises a first non-return valve which connects the second line to a control line of the valve.

4. The hydraulic cylinder according to claim 3, wherein the control surface of the valve is of a stepped design.

5. A hydraulic cylinder, for example for use in a hydraulic tool, comprising at least one piston/cylinder combination composed of a cylinder body and a piston accommodated in said cylinder body and provided with a piston rod that projects from said cylinder body, wherein the cylinder body and the piston body define a first cylinder chamber while the cylinder body, the piston body and the piston rod define a second cylinder chamber, and wherein during operation the piston performs alternating forward and return operational cycles under the influence of a fluid under pressure that is conducted to the first and the second cylinder chamber through a first and a second line, respectively, a control valve which regulates the supply of a fluid under pressure through the first or the second line to the piston/cylinder combination, and a separation valve which regulates the discharge of fluid under pressure from the second cylinder chamber in dependence on the pressure difference between the first and the second cylinder chamber, and a safety valve which is passive in a first position and which in a second position, if the pressure in the second cylinder chamber is higher than a preset load pressure, the second cylinder chamber comes into communication with the first cylinder chamber via the separation valve;

wherein the safety valve comprises a valve which in its first position maintains the pressure in a control line of the separation valve and which in its second position releases the pressure in the control line of the separation valve.

6. The hydraulic cylinder according to claim 5, wherein the safety valve comprises a first non-return valve which connects the second line to a control line of the valve.

7. The hydraulic cylinder according to claim 6, wherein the control surface of the valve is of a stepped design.

8. The hydraulic cylinder according to claim 7, wherein the safety valve comprises a further non-return valve which connects the second line to the control line of the separation valve.

* * * * *